United States Patent [19]

Johnson

[11] Patent Number: 4,498,615

[45] Date of Patent: Feb. 12, 1985

[54] GOLF TEE HOLDER

[75] Inventor: Elizabeth A. Johnson, Indianapolis, Ind.

[73] Assignee: Edward J. Erpelding, Indianapolis, Ind.

[21] Appl. No.: 526,552

[22] Filed: Aug. 26, 1983

[51] Int. Cl.[3] ..... A63B 57/00

[52] U.S. Cl. ..... 224/274; 24/444; 224/901; 224/918

[58] Field of Search ..... 206/443; 224/274, 901, 224/918, 917, 222, 191; 248/467, 205 R; 24/306, 444, 442; 2/DIG. 6

[56] References Cited

U.S. PATENT DOCUMENTS

| | | | |
|---|---|---|---|
| 1,723,276 | 8/1929 | Gottlieb . | |
| 2,321,360 | 6/1943 | Chambers . | |
| 2,379,934 | 7/1945 | Seiferth | 206/443 X |
| 2,564,955 | 8/1951 | Brooks | 224/191 |
| 2,691,779 | 10/1954 | Bell . | |
| 3,010,628 | 11/1961 | Kowalczyk | 224/274 |
| 3,273,891 | 9/1966 | Grim, Jr. | 248/467 X |
| 3,350,045 | 10/1967 | Mayers | 248/467 |
| 3,543,977 | 12/1970 | Lockridge | 224/222 |
| 3,674,189 | 7/1972 | Walbeck . | |
| 3,726,752 | 4/1973 | Provost | 24/444 X |
| 3,940,873 | 3/1976 | Lawless | 206/349 X |
| 3,968,522 | 7/1976 | Riess . | |
| 4,341,331 | 7/1982 | McDougall | 224/901 X |
| 4,420,082 | 12/1983 | Bernie | 248/467 X |

*Primary Examiner*—Stephen Marcus
*Assistant Examiner*—Robert Petrik
*Attorney, Agent, or Firm*—Woodard, Weikart, Emhardt & Naughton

[57] ABSTRACT

A device for holding a plurality of golf tees. A flexible strip has an adhesive backed surface covered by a sheet protecting the adhesive until the strip is mounted to an external object. A cover strip is removably mounted to the flexible strip and is secured thereto by means of a loop and hook fabric fastener extending across the entire area of the mutually facing surfaces of the flexible strip and cover. The fabric fastener releaseably holds the flexible strip and cover strip together with a plurality of golf tees positioned therebetween.

3 Claims, 3 Drawing Figures

GOLF TEE HOLDER

BACKGROUND OF THE INVENTION

This invention is in the field of appliances associated with the game of golf and more specifically a device for holding a plurality of golf tees. A golfer must repetitively store and then subsequently locate a golf tee for each tee shot. The tees may be stored in the golf bag or carried in the golfer's pocket. Another practice is to store the tees in a holder mounted on a golf cart, although the tees will frequently fall therefrom. A number of devices have been designed to conveniently hold tees. For example, U.S. Pat. Nos. 3,968,522 issued to Riess, 3,674,189 issued to Walbeck, 2,691,779 issued to Bell, 2,321,360 issued to Chambers and 1,723,276 issued to Gottlieb all disclose various types of pockets or loops for holding golf tees mounted to a variety of places including hats, shoes and belts.

Each golfer may find it more convenient to locate and store the golf tees in a particular different spot as compared to another golfer. None of the prior golf tee holders are designed to allow the golfer to determine the location of the mounting of the holder. Disclosed herein is a golf tee holder which may be mounted to any portion of the golfer's clothing, golf bag, cart or other suitable position determined by the golfer.

The golf tee holder disclosed herein is also designed to allow golf tees to be mounted in a very quick manner as compared to the prior holders. Instead of requiring the golfer to insert each particular tee into a loop or separate pocket as is the case with the prior holders, the holder disclosed herein is designed to allow insertion of the tee at any location and at any angle between a pair of strips fastened together. The strips are separable by the action of the tee being inserted therebetween but remain securely fastened together immediately adjacent the tee ensuring superior mounting of the tee as compared to the prior holders. The holder is designed to alleviate the necessity for opening and closing the holder as compared to the prior holders with a novel feature being the holder mountedly receiving the tees by the insertion of the tees into the holder.

SUMMARY OF THE INVENTION

One embodiment of the present invention is a golf tee holder comprising a strip having a front surface and a back surface with mounting means on the back surface to mount the strip to an external object, a cover removably mountable to the front surface and extending over and adjacent the strip to secure golf tees therebetween, and synthetic fabric fastening means on the front surface and the cover to releaseably hold the cover to the strip and golf tees therebetween.

Another embodiment of the present invention is a device for holding golf tees comprising a first flexible elongated strip having an adhesive backed surface to conformingly mount the strip onto an object and a forward surface with a synthetic loop constructed fabric provided thereon, an adhesive cover removably mounted to the adhesive backed surface, and a second flexible elongated strip of size identical to the first strip and including a synthetic hook constructed fabric surface releaseably engageable with the loop constructed fabric to hold the first strip and second strip releaseably together and golf tees positioned therebetween.

A further embodiment of the present invention is the combination of a plurality of golf tees having spaced apart shanks, a flexible strip with an adhesive back surface to mount to an external object and with an outwardly facing surface, a cover strip removably mounted to the flexible strip and positioned in contact with the outwardly facing surface except where the shanks extend between the flexible strip and the cover strip, and means on the outwardly facing surface and the cover strip to releaseably but tightly hold the cover strip to the flexible strip along the outwardly facing surface except where the shanks extend between the flexible strip and the cover strip.

It is an object of the present invention to provide a new and improved golf tee holder.

A further object of the present invention is to provide a pair of flexible strips removably secured together by hook and loop fasteners and between which may be positioned a plurality of golf tees.

In addition, it is an object of the present invention to provide a golf tee holder which may be mounted in a location as determined by the golfer.

A further object of the present invention is to provide a golf tee holder allowing a plurality of golf tees to be insertedly mounted into a holder without the normal opening and closing of fastening devices.

Related objects and advantages of the present invention will be apparent from the following description.

DESCRIPTION OF THE PREFERRED EMBODIMENT

Figure 2:
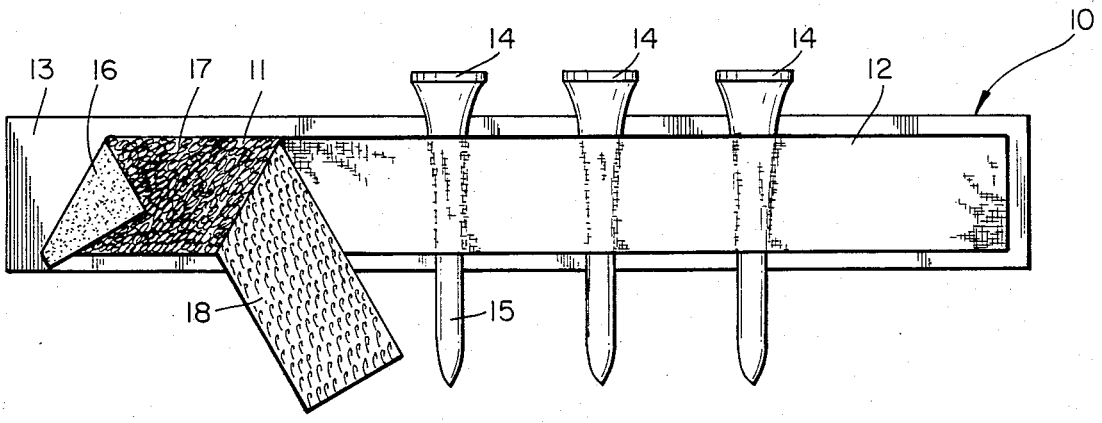
FIG. 2 is an enlarged front view of the golf tee holder with the corners of the strips pulled upwardly to show the back surfaces thereof.

For the purposes of promoting an understanding of the principles of the invention, reference will now be made to the embodiment illustrated in the drawings and specific language will be used to described the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
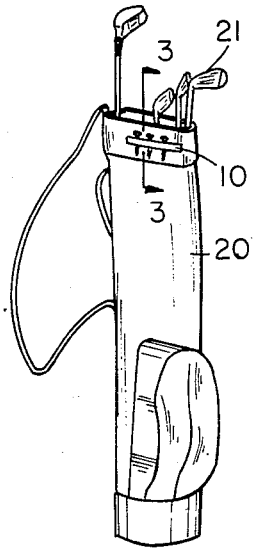
FIG. 1 is a perspective view of a golf bag having the holder incorporating the present invention mounted thereto.
Figure 3:
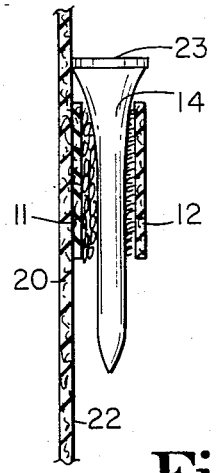
FIG. 3 is a fragmentary enlarged cross-sectional view taken along the line 3—3 of FIG. 1 and viewed in the direction of the arrows.

Referring now more particularly to FIGS. 1 and 2, there is shown a golf tee holder incorporating the present invention mounted to a conventional golf bag 20 having a plurality of clubs 21 positioned therein. Holder 10 includes a flexible strip 11 upon which a cover strip 12 is removably mounted thereto. Strip 11 and cover 12 are identical in size and configuration. A removable sheet 13 is mounted to the adhesive back surface 16 of flexible strip 11 and may be removed therefrom to allow the back surface 16 to be secured to an external object. The adhesive extends along the entire area of back surface 16 thereby allowing strip 11 to be conveniently mounted to a person's clothing, golf bag, cart or other suitable object. The adhesive utilized on the back surface is conventional in nature and the sheet 13 may be discarded once the flexible strip is mounted to the external object.

Flexible strip 11 has an outwardly facing surface upon which a plurality of closed loops 17 are mounted. Loops 17 form a synthetic fabric material engageable with hooks 18 mounted to the back surface of cover strip 12. Loops 17 and hooks 18 extend along the entire mating and adjacent mutually facing surfaces of strip 11 and cover 12 with the hooks forming a synthetic fabric. Loops 17 and hooks 18 are conventional in nature and compose a fabric fastener available under the trademark VELCRO ® from Velcro USA, Inc.

A plurality of golf tees 14 each have a shank 15 extending between strip 11 and cover 12. To mount the golf tees to holder 10, the golfer forces the pointed end of shank 15 of the tee 14 between surfaces 17 and 18 of strips 11 and 12 until the head of the tee is positioned immediately above the strips. The hooks on surface 18 and engaged loops on surface 17 are operable to tightly secure the strips together immediately adjacent the shank of each tee thereby tightly holding the strips together and preventing the accidental removal of the tee from the holder. Further, the enlarged head 23 of tee 14 is forced against the outward surface 22 of the external object or bag 20 upon which strip 11 is mounted. Strip 11 is sufficiently thin to require contact of head 23 against surface 22 whenever the tee is positioned between the two strips. The force exerted by head 23 against surface 22 further locks the tee in position and coupled with the holding power of one strip relative to the other strip provides superior holding of the tee as compared to the prior holders. Further, the tees may be inserted between the strips so that the enlarged head of one tee will contact the enlarged head of an adjacent tee further locking the tees in position. The holder disclosed herein is particularly advantageous in that the shanks of the tees may be inserted at any angle between strips 11 and 12. In other words, it is unnecessary that shank 15 be arranged perpendicularly relative to the length of each strip.

The shank of a golf tee is slightly tapered increasing in diameter near the head of the tee. Thus, many prior tee holders are ineffective to grip the tee since the tee changes in diameter through its length. The hook and loop fabric fasteners provided on strips 11 and 12 are particularly advantageous since the separation hole formed between the two strips by the insertion of the tee shank has a hole configuration identical and complementary to the tee shank. The shank is therefore tightly gripped by strips 11 and 12 along the tee shank entire length.

Both strip 11 and cover 12 are flexible being of relatively thin walled construction to conformingly fit to the external object upon which the strip is mounted. Cover 12 is positioned to contact all of the outwardly facing surface of strip 11 except where shanks 15 extend between the flexible strip and the cover. The fabric fastener formed by loops 17 and hooks 18 provide a means on the cover and strip to releaseably but tightly hold the cover to the strip along all of the outwardly facing surface of the strip except where the shanks of the tees extend therebetween.

In one embodiment, the strip had a length of at least three times its width. In this same embodiment, the strip was approximately six inches long whereas the width was approximately one inch. The end portion of cover 12 and strip 11 is shown in the drawing as turned back to more fully illustrate the back surface of the cover and the strip.

The present invention provides a new and improved golf tee holder. The golf tee holder is particularly advantageous in that it may be conveniently mounted to a particular external object.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A method of removably transporting golf tees for use, comprising the steps of:

overlying two strips of synthetic fabric comprising a hook and loop fabric fastening means so as to tightly hold said strips together along their entire contacting surfaces; and pushing in a golf tee between said strips so as to separate said strips around the shank of said golf tee and hold said golf tee therebetween, said strips being unseparated until said golf tee is pushed in between said strips.

2. The method of claim 1 wherein said two strips of synthetic fabric are Velcro ®.

3. The method of claim 1 wherein said pushing in step is repeated in order to hold a plurality of golf tees between said strips.

* * * * *